US007089614B1

(12) United States Patent
Clapp

(10) Patent No.: US 7,089,614 B1
(45) Date of Patent: Aug. 15, 2006

(54) BODY PILLOW

(75) Inventor: Dennis Michael Clapp, Los Angeles, CA (US)

(73) Assignee: Spillow, Inc., West Los Angeles, CA (US)

( * ) Notice: Subject to any disclaimer, the term of this patent is extended or adjusted under 35 U.S.C. 154(b) by 0 days.

(21) Appl. No.: 10/974,544

(22) Filed: Oct. 25, 2004

Related U.S. Application Data

(60) Provisional application No. 60/534,023, filed on Jan. 5, 2004.

(51) Int. Cl.
*A47C 16/00* (2006.01)

(52) U.S. Cl. ..... 5/632; 5/652

(58) Field of Classification Search ..... 5/630–633, 5/652, 657; 128/845; D6/601
See application file for complete search history.

(56) References Cited

U.S. PATENT DOCUMENTS

| | | | | |
|---|---|---|---|---|
| 4,173,048 | A | 11/1979 | Varaney | |
| D264,164 | S | 5/1982 | Salibello et al. | |
| 4,624,021 | A | 11/1986 | Hofstetter | |
| D293,990 | S | 2/1988 | Brooksby | |
| 4,731,890 | A | 3/1988 | Roberts | |
| 4,754,510 | A | 7/1988 | King | |
| D303,897 | S | 10/1989 | Phillips | |
| 4,901,384 | A * | 2/1990 | Eary | 5/632 |
| D306,948 | S | 4/1990 | Zollinger | |
| D307,369 | S | 4/1990 | Zollinger | |
| D310,609 | S | 9/1990 | Burkhardt | |
| 5,097,551 | A | 3/1992 | Smith | |
| D353,173 | S | 12/1994 | Almeda | |
| D365,241 | S | 12/1995 | Braden et al. | |
| 5,519,906 | A | 5/1996 | Fanto-Chan | |
| D377,881 | S | 2/1997 | Watt | |
| D387,599 | S | 12/1997 | Ryndak | |
| 5,978,990 | A | 11/1999 | Akey | |
| 5,987,674 | A | 11/1999 | Schaffner et al. | |
| D418,987 | S | 1/2000 | Panton | |
| D419,819 | S | 2/2000 | Bartoli | |
| 6,052,848 | A | 4/2000 | Kelly | |
| 6,088,854 | A | 7/2000 | Brownrigg | |
| D453,653 | S | 2/2002 | Tunnell | |
| 6,499,164 | B1 | 12/2002 | Leach | |
| 6,751,817 | B1 * | 6/2004 | Leach | 5/632 |
| D492,533 | S | 7/2004 | Cole | |
| 6,874,183 | B1 * | 4/2005 | Taylor | 5/632 |

* cited by examiner

*Primary Examiner*—Michael Trettel
(74) *Attorney, Agent, or Firm*—Knobbe, Martens, Olson & Bear, LLP

(57) ABSTRACT

A pillow is described herein. The pillow including an upper section, a lower section, and an interconnecting section that interconnects the upper section to the lower section such that a user in a first position can interpose the upper section between his or her arms and can interpose the lower section between his or her legs while his or her legs are bent at the hip at substantially a right angle. Also, the upper section, the lower section and the interconnecting section are dimensioned such that the interconnecting section separates the lower section from the upper section a distance sufficient to space the lower section from the user's crotch when the user is in the first position.

16 Claims, 6 Drawing Sheets

BODY PILLOW

This application claims the benefit of Provisional Application Ser. No. 60/534,023, filed on Jan. 5, 2004.

BACKGROUND OF THE INVENTION

1. Field of the Invention

The present invention generally relates to a body pillow. More specifically, the present invention relates to body pillow shaped to substantially support and cushion a user lying on the user's side with his or her knees bent and can alternatively support a user's back when the user rests in a sitting position.

2. Description of the Related Art

Many people prefer to sleep laying on their side with their head slightly forward, their arms and legs bent in front of them at the shoulders and hips, and their knees bent, this position sometimes being referred to as the "fetal position." Many doctors and sleep experts believe this is a favorable position because it allows a person's muscles to relax. Also, many people simply find it a comfortable sleeping position.

The fetal position also relieves pressure from a person's spine allowing their back to relax more than other positions. Many people, including many doctors, believe it is ideal to have their legs held apart while sleeping such that a person's leg bones are generally parallel to each other with their feet approximately shoulder-width apart. To state it differently, this leg position is similar to the manner in which a person's legs appear when sitting with proper posture in a chair.

Pillows or other objects are needed, however, to support and position a person's body in the fetal position. One or more pillows placed beneath a person's head can support the head, allowing neck and shoulder muscles to fully relax. Also, another pillow placed between a person's knees can support a person's legs, allowing the hip and thigh muscles to fully relax, while at the same time cushioning the relatively hard, boney regions of the knees. Similarly, a pillow positioned between a user's ankles can support the ankles and cushion the boney regions of the ankles.

Additionally, many people generally find the fetal position to be the most comfortable and natural sleeping position. Often, two people sleeping together will both sleep in the fetal position, lying closely together and facing the same direction. This position is sometimes referred to as "spooning" and often gives people a sense of togetherness and security, as well as comfort. Sometimes people sleeping alone will sleep in the fetal position and clutch an extra pillow between their arms and chest, in some ways simulating the act of spooning.

One problem with using a traditional pillow to support the knees and/or ankles in such a position is traditional pillows are rectangular and cannot account for areas a person does not want support. In particular, a traditional pillow placed between a person's thighs often has the undesirable result of one corner of the pillow contacting a person's crotch which can be uncomfortable. Moreover, grasping a traditional pillow to a person's torso often results in the pillow being positioned in the person's crotch such that the width of the pillow is positioned between the crotch and knees. In this orientation, often the person's knees are not separated by the pillow which can be a less comfortable position for the person.

Further, today's pillows are typically suitable for supporting only one particular body part. For example, standard pillows on the market today support the head, but cannot support the legs and head at the same time. People instead often employ multiple individual pillows to support the head, knees, ankles, and other specific body parts. Thus, many people require an excess of pillows, each of which is typically purchased individually and requires an individual pillow case, totaling a significant cost.

It is therefore believed that a need exists for a pillow that substantially supports a person's body as they lie in the fetal position and allows the muscles to naturally relax, allows desirable spacing at a person's crotch region, and can also simulating the act of spooning by providing a cushion for the user to grasp.

SUMMARY OF THE INVENTION

The aforementioned needs are addressed by the pillow of the present invention which has multiple embodiments and uses. In some embodiments, the present invention includes a pillow with an upper section, a lower section, and an interconnecting section that interconnects the upper section to the lower section. The pillow allows a user in a first position to interpose the upper section between their arms and interpose the lower section between their legs with their back substantially straight and legs bent at the hip at substantially a right angle. In this position, the pillow provides support for a user's head, torso, and legs and assists in maintaining a desirable alignment of the neck, spine, and legs. Also, the upper section, the lower section and the interconnecting section are generally dimensioned such that the interconnecting section separates the lower section from the upper section a distance sufficient to space the lower section from the user's crotch when the user is in the first position. Further, the dimensions of the upper section typically correspond with the length of a user's torso and arms, such that the torso can be fully supported by the upper section and a user can effectively wrap his or her arms around the upper portion. Also, the dimensions of the interconnecting portion generally relate to that of a user's thighs, and the dimensions of the lower potion generally relate to the dimensions of a user's lower leg.

In another aspect of some embodiments, the upper section may be folded upwardly and used as a back support by a user sitting in a second position. In this second position, the lower section serves as an arm support for the user. This second position is advantageous to users who may be reading in bed as it supports and cushions the person's back while also providing an arm rest.

In another aspect of some embodiments, the pillow of the present invention can be used to support a person's stomach, particularly to support the stomach of a pregnant woman. The interconnecting portion of the pillow includes a stomach support surface and aides in supporting the weight of a user's stomach when the user lies in a third position. In this third position, the user can wrap his or her arms around the upper portion, pulling the upper portion against his or her chest, thereby effectively wrapping the upper portion around the user's stomach.

In another aspect of some embodiments of the present invention, the pillow provides a feeling of security by allowing a person to clutch the pillow to their chest while at the same time intertwining his or her legs with the pillow.

BRIEF DESCRIPTION OF THE DRAWINGS

These and other features, aspects and advantages of the present invention will now be described with reference to the drawings of a preferred embodiment, which embodiment is intended to illustrate and not to limit the invention, and in which figures.

DETAILED DESCRIPTION OF THE ILLUSTRATED EMBODIMENTS

A body pillow designed to provide comfort and function is disclosed herein. Among other things, the pillow provides support surfaces for the head, arms, legs, and knees, and also provides a cushion for a person to grasp while lying or sitting, particularly while sleeping, resting, or reading.

Figure 1:
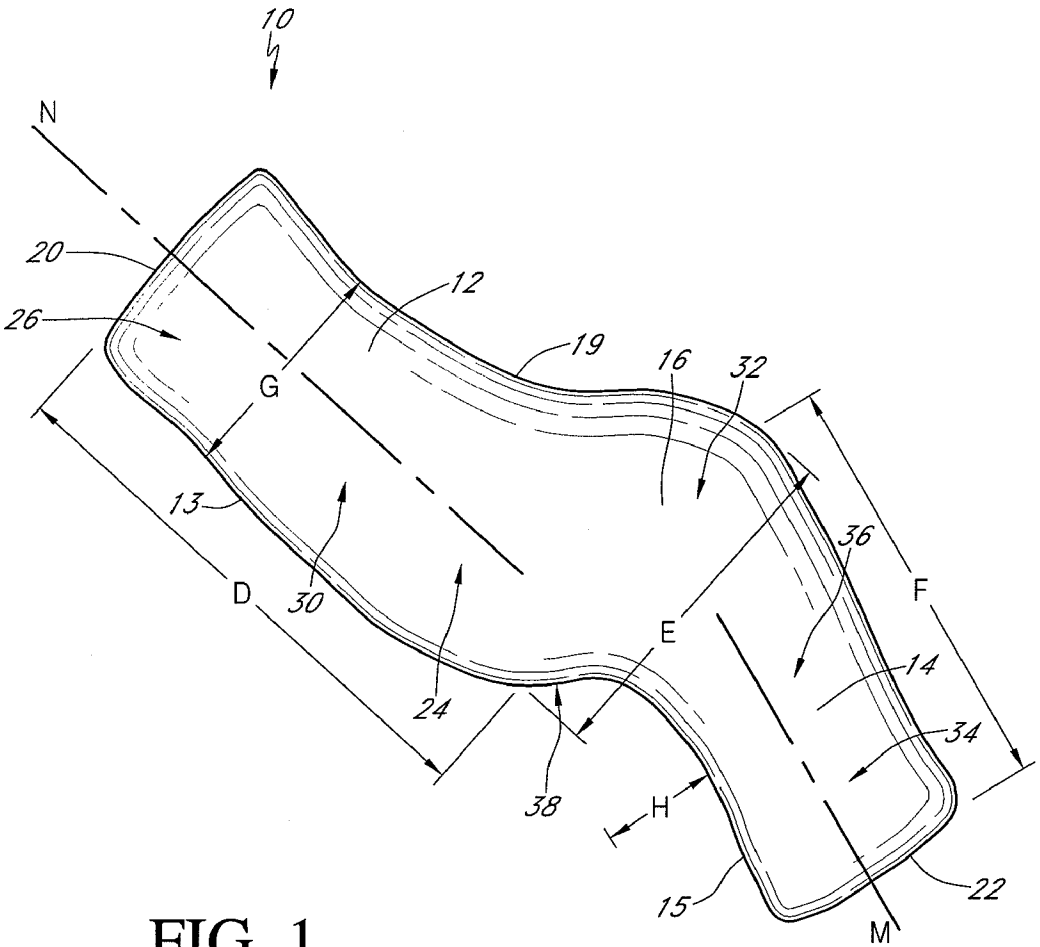
FIG. 1 is a perspective view of one embodiment of the pillow of the present invention.

With reference now to FIG. 1, a pillow 10 is shown in accordance with an embodiment of the present invention. The pillow 10 includes an upper portion 12, a lower portion 14, and an interconnecting portion 16 connecting the upper and lower portions 12 and 14. The pillow 10 also includes a first edge 13 and a second edge 15. The pillow 10 is generally soft and pliable and designed to provide cushioning. The materials used to construct the pillow 10 can be any of those utilized in the prior art, such as, for example, a fabric outer casing filled with cotton, feathers, or other filling material. Horizontal lines bisecting the upper portion 12, lower portion 14, and interconnecting portion 16 generally lie in an imaginary plane X, which is parallel to the page, that therefore generally horizontally bisects the pillow 10. Thus, many embodiments of the pillow 10 are generally symmetrical about plane X.

The upper portion 12 extends longitudinally from the interconnecting portion 16 and includes an upper end 20. The upper portion 12 also includes a head support region 26 positioned near the upper end 20. In preferred embodiments, the head support region 26 substantially supports the weight of a user's head, thereby relieving the neck and shoulders, as is known in the prior art. An arm support region 30 is also shown in FIGS. 1. In preferred embodiments, the arm support region 30 can support the weight of a user's arm when the pillow is in use, thereby relieving the shoulder, arm, and back muscles of this weight. While it is not necessary, many preferred embodiments of the pillow 10 include an upper portion 12 that is generally symmetrical about the centerline N. Also, the length D of the upper portion 12 is often designed to relate to the length of a user's torso such that the longer lengths D are provided for people with longer torsos and vise versa. The length D can vary for different sized users, but preferred lengths for adult users are often between 28 inches and 36 inches, with 32 inches being a length used in one implementation.

FIG. 1 also shows the interconnecting portion 16 that extends generally laterally relative to the upper portion 12 and the lower portion 14. The interconnecting portion 16 merges into a knee support region 32 designed to support the weight of a user's legs and knees and also to cushion a user's knee bones. The interconnecting portion 16 also includes a crotch region 38 at or near the first edge 13. The crotch region 38 corresponds with a curve in the first edge 13 such that the curved crotch region 36 typically continues along the first edge 13 from the upper portion 12 to the lower portion 14. The crotch region 38 can have any range of curvatures or a sharp corner, but a radius of curvature between 80 and 100 degrees is preferred, with 90 degrees being very common. The interconnecting portion 16 is often designed to have a length E the generally extends from the crotch region to the opposite edge of the interconnecting portion. The length E usually bears a direct relationship to the typical length of a user's upper leg, with longer lengths E designed for users with longer upper legs and vice versa. For adult users, common lengths E are between 22 inches and 26 inches, with 24 inches being used in one implementation. As those skilled in the art will realize, the length E can be increased or decreased to account for taller or shorter users.

As is also shown in FIG. 1, the lower portion 14 extends longitudinally from the interconnecting portion 16 in a direction generally away from the upper portion 12 to a bottom end 22. Near the bottom end 22 is an ankle support region 34. The lower portion 14 also includes a calf support region 36 located between the knee support region 32 and the ankle support region 34. While it is not necessary, in many embodiments, the first edge 15 of the lower portion 14 is generally parallel to the first edge 13 of the upper portion 12. Also, edge 15 is generally off-set from edge 13 by a distance H. Lower portion 14 also includes a length F that extends from the interconnecting portion 16 to the bottom end 22. Length F generally relates directly to the length of a user's lower leg such that length F is increased for users with long legs and decreased for users with short legs. In other words, length F can be varied during the manufacture of the pillow 10 to account for different users to ensure that a user's knees, calves, ankles, and feet can be fully supported. For adult users, common lengths F are between 22 inches and 26 inches, with 24 inches being used in one implementation. As those skilled in the art will realize, the length F can be increased or decreased to account for taller or shorter users.

Figure 2:
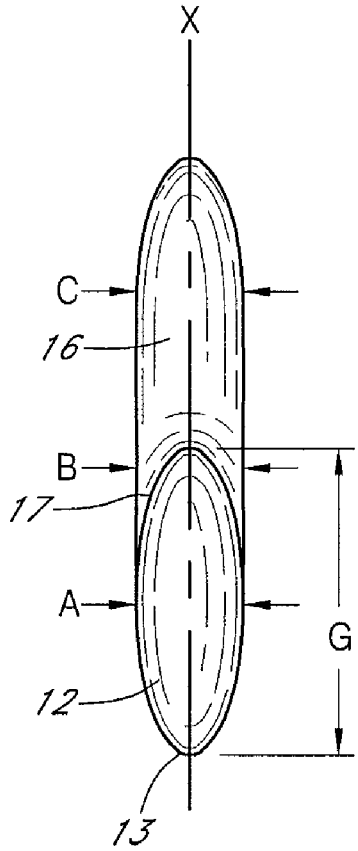
FIG. 2 is an end view of one embodiment of the pillow of the present invention.

Referring now to FIG. 2, the thickness A, the width G, and the general shape of the upper portion 12 are shown. The thickness A and width G can be varied to provide different dimensions and shapes for a perimeter 17 of the upper portion 12. Perimeter 17 of the upper portion 12 can be easily deformed when in use and generally offers some resiliency and cushioning. The perimeter 17 of the upper portion 12 may have any shape when not in use but typically includes a minimal resiliency to a resting shape that is oblong, oval, ovoid, elliptical, egg-shaped, rectangular, or rounded. FIG. 2 shows one preferred, generally oval shaped perimeter of the upper portion 12. The dimensions of the perimeter of the upper portion 12 can be varied during manufacturing, with preferred embodiments typically including perimeters 17 that allow a user to wrap his or her arms around the upper portion 12. Users with relatively narrow shoulders generally prefer relatively small dimensions for thickness A while users with broad shoulder prefer larger dimensions for thickness A. For many preferred embodiments, thickness A is between 7 inches and 8 inches, with 7.5 inches being common. Similarly, the dimensions chosen for width G typically have a direct relationship to the lengths of a user's arms. Users with longer arms typically prefer larger dimensions for width G while users with shorter arms prefer relatively smaller dimensions for width G. Many embodiments feature width G between 10 inches and 14 inches, with 12 inches being used in one implementation.

FIG. 2 also shows thickness B of the interconnecting portion and thickness C of the lower portion 14. Thickness B of the interconnecting portion is designed to bear a relationship to the width of a user's hips to provide a comfortable spacing for a user's legs. By designing the pillow 10 to have an appropriate thickness B, the pillow 10 can hold a user's legs approximately shoulder width apart, which many users find very comfortable. In this position, the user's legs are generally parallel to each other, allowing the spine to lie relatively straight while the user's back muscles fully relax. For people with wide hips, thickness B is increased to allow for this favorable spacing. Conversely, thickness B is decreased for people with narrow hips. Typically, thickness B is between 6 inches and 10 inches, with 8 inches being used in one implementation. Thickness C of the lower portion 14 is generally at its maximum at or near the centerline L and preferably tapers toward the first edge 13. In some embodiments the thickness of the lower portion 14 also tapers toward the second edge 15. The tapering thickness of the lower portion 14 allows a user to position his or her legs at a desired location depending on the user's preferred thickness which may correspond, either directly or inversely, to the thickness of his or her legs. In this manner, a user may position his or her knees at a thick portion of the pillow 10 to gain maximum support of the user's knees while positioning the user's lower legs such that the calf muscle is supported by a thinner portion of the pillow 10, thereby allowing the calf muscle to more fully relax.

Figure 3:
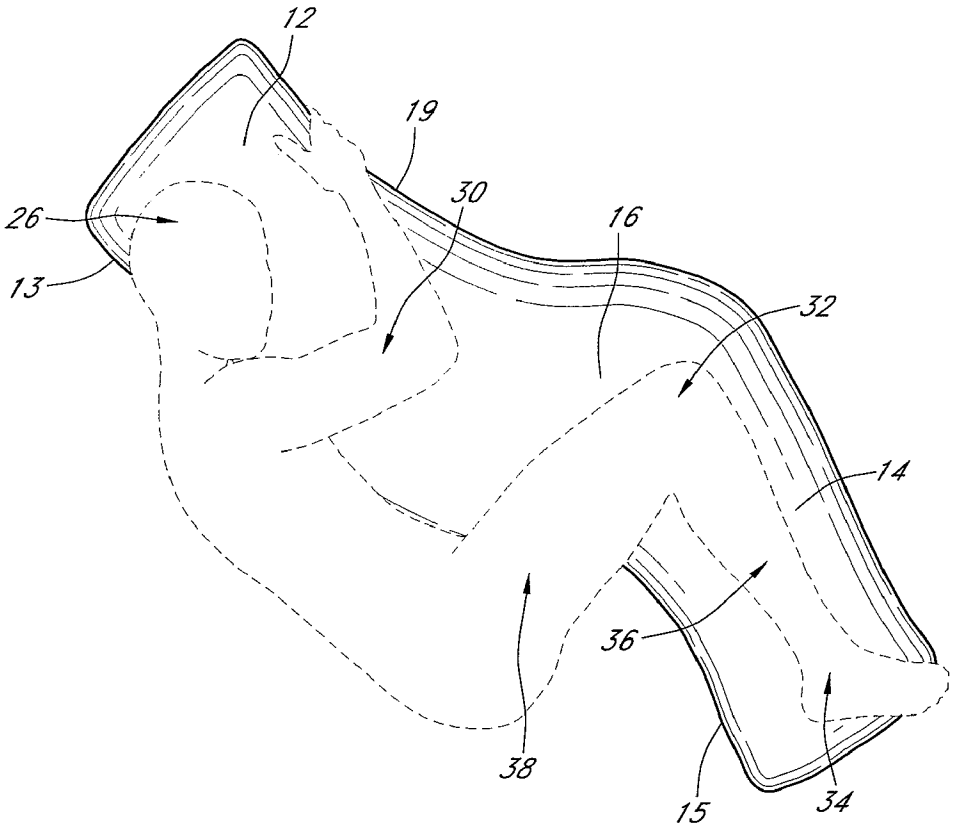
FIG. 3 is a side view of one embodiment of the pillow of the present invention showing a user in phantom lines as the user may clutch the pillow.

Many users find it comfortable to wrap one or both arms around the upper portion 12 in a hugging fashion as shown in FIG. 3. Hugging the pillow in this way also provides a feeling of security and, in a sense, allows users to pretend he or she is with his or her sleeping partner. As will be more fully described below, this also aids in allowing a user to mimic the act of spooning.

FIG. 3 also shows how the crotch region 38 can be variably positioned by the user to provide a spacing near the user's crotch as the user uses the pillow 10. As shown in FIG. 3, the user may clutch the upper portion 12 against his or her chest and, at the same time, rest his or her knees on the knee support region 32 while the crotch region 38 provides a desirable spacing between the pillow 10 and the user's crotch. FIG. 3 also shows how pillow 10 can, at the same time, support a user's head, arms, torso, thighs, knees, calves, ankles and feet.

In many embodiments, the knee support region 32 has a thickness B designed to position a user's knees at a desirable, comfortable spacing when a user places knee support region 32 between his or her knees. The thickness of the interconnecting portion 16 generally tapers from the knee support region 32 toward the first edge 13. Accordingly, placing the knee support region 32 between a user's knees as shown in FIG. 5 also has the effect of positioning a person's thighs in a comfortable, spaced-apart manner. Embodiments in accordance with FIG. 4 allow a user to position the knee support region 32 between a his or her knees and the crotch region 38 generally above and in front of the user's hip socket, such that the tapering thickness of the interconnecting portion 16 roughly corresponds to the increased thickness of a user's thighs. In other words, FIG. 4 shows that some embodiments of the pillow 10 support a user's knees at the knee support region 32 while the tapering thickness near the first edge 13 allows the thickest part of a user's thighs to generally contact the thinnest part of the interconnecting portion 16.

Figure 4:
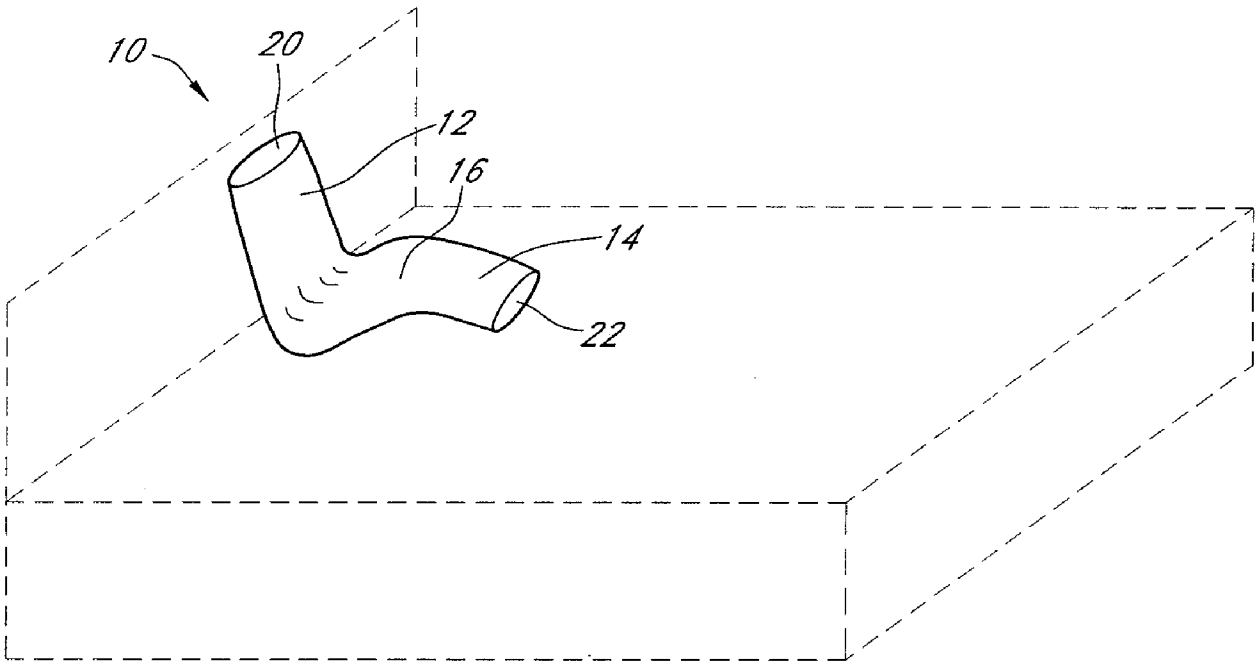
FIG. 4 is a perspective view of a pillow in accordance with some embodiments of the present invention showing the pillow in a second, folded position on a bed, shown in phantom lines.
Figure 5:
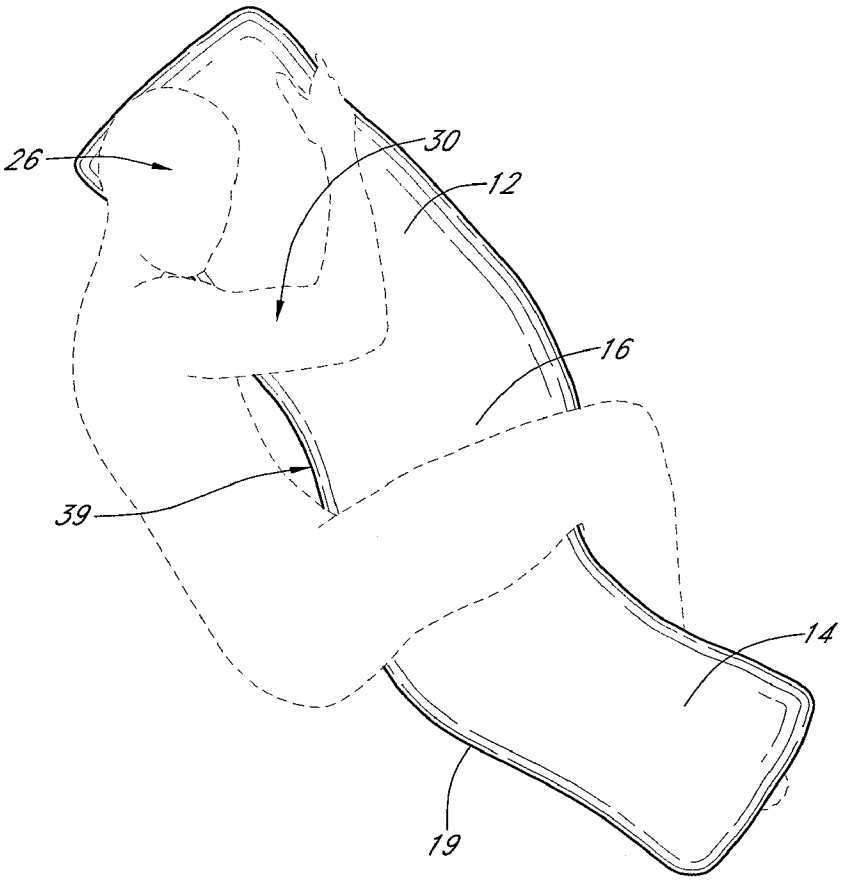
FIG. 5 is a side view of a pillow in accordance with some embodiments of the present invention showing the pillow being used in a third position.

FIG. 4 depicts embodiments that allow the pillow 10 to be bent into a reading position. In these embodiments, the upper portion 12 and the interconnecting portion 16 generally meet at a flex region 24. The upper portion 12 can be selectively flexed about the bending region 24 such that the upper portion 12 generally forms an angle with respect to imaginary plane X as is shown. In this manner, the upper portion 12 may be bent into a number of selectable orientations. In the reading position depicted in FIG. 4, a user may sit on a relatively flat surface, such as the bed shown in FIG. 4 in phantom lines, with the upper portion 12 and interconnecting portion positioned behind the user and the lower portion 14 positioned beside the user. In this position, the user may rest his or her head, neck and/or back against the upper portion and rest his or her elbow, arm, and/or hand on the lower portion 14. May users find this position comfortable when reading, watching television, or the like. Also, as with the upper portion 12, the lower portion 14 also includes a flex region 25 about which the lower portion can bend. Further, given the typical pliable materials used in the manufacture of pillow 10, the pillow 10 can be bent, curved, curled, squeezed, compressed, and folded at other places.

FIG. 5 depicts some embodiments of the pillow 10 having a stomach support region 39. The stomach support region 39 is located at or near the interconnecting portion 16, at or near a second edge 19. The stomach support region 39 is generally a rounded surface, although a square or any other shaped support surface will suffice. Using the pillow 10 in the manner shown in FIG. 5, a user may support his or her stomach against the stomach support region 39 by bending the upper portion 12 around the person's stomach. To support a user's stomach in this manner, the user can clutch the upper portion 12, pulling it toward his or her body, while at the same time positioning the interconnecting portion 16 between the person's legs, thereby effectively wrapping the stomach support region 39 around the person's stomach. The person can vary the position of the interconnecting portion to provide varied amounts of support to the stomach. By positioning the interconnecting portion substantially forward from a person's crotch, the pressure on a person's stomach is minimized. In contrast, positioning the interconnecting portion 16 rearwardly will increase the pressure against the stomach to provide more support. The user may also selectively interpose the interconnecting portion 16 between his or her knees. Also, the user may and optionally interpose the lower portion 14 between his or her legs or ankles, as described above. Pregnant women in particular generally find this position helpful in cushioning and supporting the weight of their stomachs.

Figure 6:
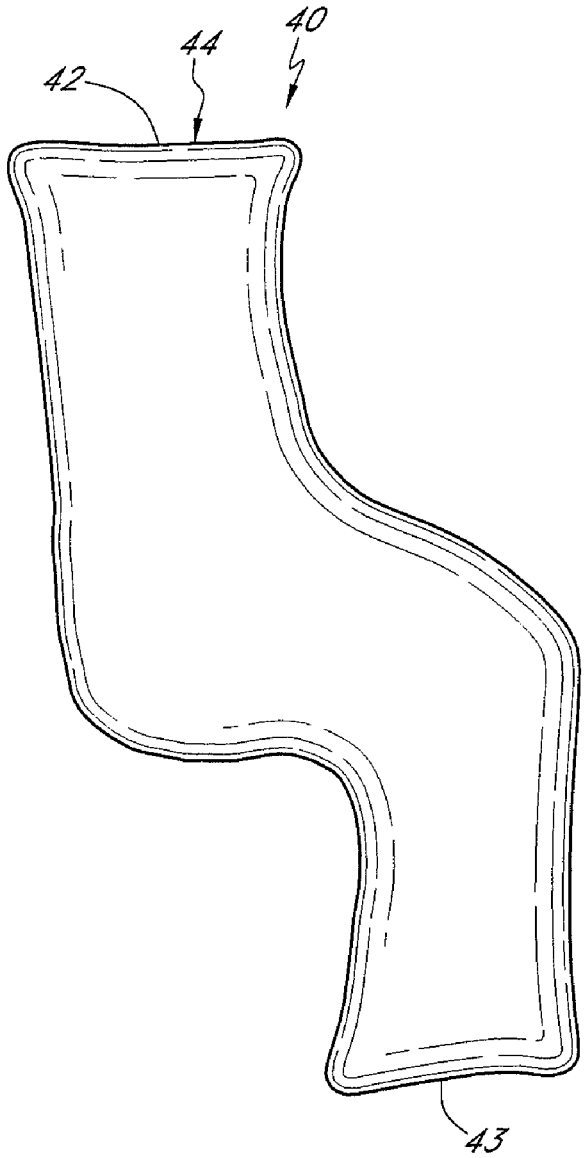
FIG. 6 is a side view of a pillow case in accordance with some embodiments of the present invention.

The pillow 10 often includes a pillow case 40, as shown in FIG. 6. The pillow case 40 is generally tubular with three sides sewn shut and an open end 42. The pillow 10 can be slid in and out of the pillow case 40, allowing the pillow case 40 to be washed separately from the pillow 10. In some embodiments, the pillow case 40 has a zipper 44 that can close the open end 42. Any mechanical closure can be used in place of the zipper 42. The pillow case 40 is generally the same shape as the pillow 10. To facilitate insertion of the pillow 10 into the pillow case 40, a user can grasp the open end 42 and gather up the remaining part of the pillow case such that a closed end 43 is brought near the open end. With the closed end 43 near the open end 42, the pillow 10 can be inserted while simultaneously unfurling the pillow case 40.

Any number of materials can be used for the pillow case, with a preference for soft, pliable materials such as cotton.

As described above, the pillow 10 of the present invention provides a number of improvements over the prior art. The pillow 10 comprises a comfortable pillow that people who sleep in the fetal position find helpful in that, with a single pillow, users can support their head, arms, thighs, knees, calves, and ankles. Further, many embodiments of the pillow 10 are designed to provide spacing between the pillow and a user's crotch while the user is engaged with the pillow. The pillow 10 also provides a comfortable feeling as people can clutch the pillow 10 to their chest and between their legs in a manner similar to the way in which a person spoons his or her partner. Further, many embodiments of the pillow 10 allow people to fold one section of the pillow 10 upward to provide a back support when a user is sitting in bed, for example, when a user is reading in bed. Further still, many embodiments allow a user to support his or her stomach with the pillow 10 by clutching the upper portion 12 to their chest while positioning the remainder of the pillow 10 between their legs and behind them such that the upper portion 12 is effectively wrapped around the user's stomach.

Although the present invention has been described in terms of a certain embodiment, other embodiments apparent to those of ordinary skill in the art also are within the scope of this invention. Thus, various changes and modifications may be made without departing from the spirit and scope of the invention. For instance, various components may be repositioned as desired. Moreover, not all of the features, aspects and advantages are necessarily required to practice the present invention. Accordingly, the scope of the present invention is intended to be defined only by the claims that follow.

What is claimed is:

1. A pillow comprising:

an upper section that extends longitudinally in a substantially straight first direction;

a lower section that extends longitudinally in a substantially straight second direction; and an interconnecting section that extends longitudinally in a third direction that intersects the first and second directions wherein the interconnecting section interconnects the upper section to the lower section such that a user in a first position can interpose the upper section between their arms and can interpose the lower section between their legs when their back is substantially straight so as to be substantially parallel to the upper section and their legs are bent at the hip at substantially a right angle wherein the upper section, the lower section and the interconnecting section are dimensioned such that the interconnecting section separates the lower section from the upper section a distance in a third direction sufficient to space the lower section from the user's crotch when the user is in the first position.

2. The pillow of claim 1 in which the upper section extends longitudinally from the interconnecting section to a top end and the lower section extents longitudinally from the interconnecting section away from the top end to a bottom end, with the lower section extends substantially parallel to the upper section.

3. The pillow of claim 1 in which the upper section, lower section, and interconnecting section have a first orientation in which a first hypothetical plane substantially bisects the upper section, lower section, and interconnecting section;

and where the pillow may be bent about a flex section in the upper section such that the upper section can be selectively positioned in a second orientation such that a hypothetical plane bisecting the upper section forms an angle to the first hypothetical plane.

4. The pillow of claim 1, wherein the pillow is flexible and foldable into a configuration in which a user in a second position can position their back against the upper section when the user is in a sitting position.

5. The pillow of claim 1 further comprising a pillow case with substantially the same shape as the pillow wherein the pillow case is a thin, substantially hollow fabric that can removably substantially encase the pillow.

6. The pillow of claim 1, wherein the upper section has a length of between approximately 28 and 36 inches, the lower section has a length of between approximately 22 and 26 inches and the interconnection section has a length of between approximately 22 and 26 inches.

7. The pillow of claim 6, wherein the upper section has a length of approximately 32 inches, the lower section has a length of approximately 24 inches and the interconnecting section has a length of approximately 24 inches.

8. The pillow of claim 6, wherein the upper section has a thickness of between approximately 10 and 14 inches, the lower section has a thickness of between 10 and 14 inches and the interconnecting section has a thickness of between 6 and 10 inches.

9. The pillow claim 8, wherein the upper and lower section has a thickness of approximately 12 inches, and the interconnecting section has a thickness of approximately 8 inches.

10. A pillow assembly comprising:

a torso portion dimensioned so as to extend in a substantially straight first direction the length of an individual's torso thereby allowing the individual to grasp the torso portion and hold the torso portion in contact with the individual's torso such that the torso portion extends in a first direction generally parallel to the individual's torso;

a leg portion dimensioned so as to extend in a second direction the length of the individual's legs when the individual is grasping the torso portion and is in the fetal position such that the individual can grasp the leg portion between their legs; and an interconnecting portion that extends in a third direction so as to interconnect the torso portion with the leg portion to thereby space the leg portion from the torso portion such that when the individual is holding the torso portion adjacent their torso with their torso substantially parallel to the first direction and is grasping the leg portion between their legs, the leg portion is spaced away in the third direction from the individual's crotch.

11. The assembly of claim 10, wherein the torso portion extends from the interconnecting portion generally in a first direction and the and the leg portion extends from the interconnecting portion generally in a second direction that is substantially opposite the first direction such that the pillow assembly has a z-shaped configuration with the first and second portions spaced apart from each other by the interconnecting section.

12. The pillow of claim 10, wherein the torso portion has a length of between approximately 28 and 36 inches, the leg portion has a length of between approximately 22 and 26 inches and the interconnection portion has a length of between approximately 22 and 26 inches.

13. The pillow of claim 12, wherein the torso portion has a length of approximately 32 inches, the leg portion section has a length of approximately 24 inches and the interconnecting portion has a length of approximately 24 inches.

14. The pillow of claim 12, wherein the torso portion has a thickness of between approximately 10 and 14 inches, the leg portion has a thickness of between 10 and 14 inches and the interconnecting portion has a thickness of between 6 and 10 inches.

15. The pillow claim 14, wherein the torso and leg portions have a thickness of approximately 12 inches, and the interconnecting portion has a thickness of approximately 8 inches.

16. A method of making a pillow comprising:

forming a first section to have a length dimension in a first substantially straight direction substantially equal to the size of an individual's torso to thereby allow the individual to grasp the first section to their torso;

forming a second section to extend in a second direction and to have dimensions to allow the individual to grasp the section between their legs when their legs are bent at an angle with respect to the torso; and forming an interconnecting section to extend in a third direction that intersects the first and second directions wherein the interconnecting section interconnects the first and second section such that the second section is spaced away from the individual's crotch in the third direction when the individual is grasping the first section to their torso such that their torso's are substantially parallel to the first section and is grasping the second section between their legs.

* * * * *